US009743722B1

(12) United States Patent
Divranos

(10) Patent No.: US 9,743,722 B1
(45) Date of Patent: Aug. 29, 2017

(54) MUSICAL ZIPPER

(71) Applicant: Stan Divranos, Chino, CA (US)

(72) Inventor: Stan Divranos, Chino, CA (US)

( * ) Notice: Subject to any disclaimer, the term of this patent is extended or adjusted under 35 U.S.C. 154(b) by 287 days.

(21) Appl. No.: 14/712,745

(22) Filed: May 14, 2015

(51) Int. Cl.
*A44B 19/26* (2006.01)
*H04R 3/00* (2006.01)

(52) U.S. Cl.
CPC ..... *A44B 19/26* (2013.01); *A44B 19/262* (2013.01); *H04R 3/00* (2013.01); *Y10T 24/2561* (2015.01); *Y10T 24/2586* (2015.01)

(58) Field of Classification Search
CPC ... A44B 19/26; A44B 19/262; Y10T 24/2561; Y10T 24/2586; Y10T 24/2589
See application file for complete search history.

(56) References Cited

U.S. PATENT DOCUMENTS 6,026,546 A * 2/2000 Lund ..... A44B 19/262 24/415
7,304,600 B2 12/2007 Nehls et al.
8,455,758 B2 6/2013 Groset et al.
2006/0218758 A1* 10/2006 Chang ..... A44B 19/262 24/431

* cited by examiner

*Primary Examiner* — Abigail Troy
(74) *Attorney, Agent, or Firm* — Stevenson IP, LLC

(57) ABSTRACT

A musical zipper including a zipper having a slider, a continuous C-shaped flap having a pair of outer ends attached to a front surface of the slider, a pull tab engaging the flap, a pair of interlocking teeth having a first interlocking member and a second interlocking member, a speaker disposed on the front surface of the slider, and a sound chip disposed within the slider. The slider is configured to travel from a first end of the zipper to a second end of the zipper to connect the first interlocking member with the second interlocking member. The slider is configured to travel from the second end of the zipper to the first end of the zipper to disconnect the first interlocking member from the second interlocking member. The sound chip is configured to play a musical tune when the sound chip is activated.

3 Claims, 3 Drawing Sheets

MUSICAL ZIPPER

BACKGROUND OF THE INVENTION

Various types of zippers are known in the prior art. However, what has been needed is a musical zipper including a zipper having a slider, a continuous C-shaped flap having a pair of outer ends attached to a front surface of the slider, a pull tab engaging the flap, a pair of interlocking teeth having a first interlocking member and a second interlocking member, a speaker disposed on the front surface of the slider, and a sound chip disposed within the slider. What has been further needed is for the slider to be configured to travel from a first end of the zipper to a second end of the zipper to connect the first interlocking member with the second interlocking member and for the slider to be configured to travel from the second end of the zipper to the first end of the zipper to disconnect the first interlocking member from the second interlocking member. Lastly, what has been needed is for the sound chip to be configured to play a musical tune when the sound chip is activated. The musical zipper thus provides an entertaining and unique way for children or adults to personalize their clothes, since the slider can be produced in a nearly limitless number of shapes, characters, and colors, and the audio chip can be configured to play any musical tune or noise that the user so desires.

FIELD OF THE INVENTION

The present invention relates to zippers, and more particularly, to a musical zipper.

SUMMARY OF THE INVENTION

The general purpose of the present musical zipper, described subsequently in greater detail, is to provide a zipper which has many novel features that result in a musical zipper which is not anticipated, rendered obvious, suggested, or even implied by prior art, either alone or in combination thereof.

To accomplish this, the present musical zipper includes a zipper having a slider, a continuous C-shaped flap, a pull tab, and a pair of interlocking teeth. The slider has a front surface and a rear surface. The flap has a pair of outer ends attached to the front surface of the slider. The pull tab, having a top end and a bottom end, engages the flap. The pair of interlocking teeth includes a first interlocking member and a second interlocking member. A speaker is disposed on the front surface of the slider. A sound chip is disposed within the slider. The speaker and the sound chip are in operational communication with each other. The sound chip is configured to play a musical tune when the sound chip is activated.

The slider is configured to travel from a first end of the zipper to a second end of the zipper to connect the first interlocking member with the second interlocking member. The slider is configured to travel from the second end of the zipper to the first end of the zipper to disconnect the first interlocking member from the second interlocking member.

The pull tab optionally has an on position and an alternate off position. The pull tab is in the on position when the bottom end is disposed above the slider. The pull tab is in the off position when the bottom end is disposed below the slider. The pull tab is in operational communication with the sound chip. The sound chip is configured to be activated when the pull tab is in the on position. The sound chip is also optionally configured to be activated when the slider travels from the first end of the zipper to the second end of the zipper.

Thus has been broadly outlined the more important features of the present musical zipper so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
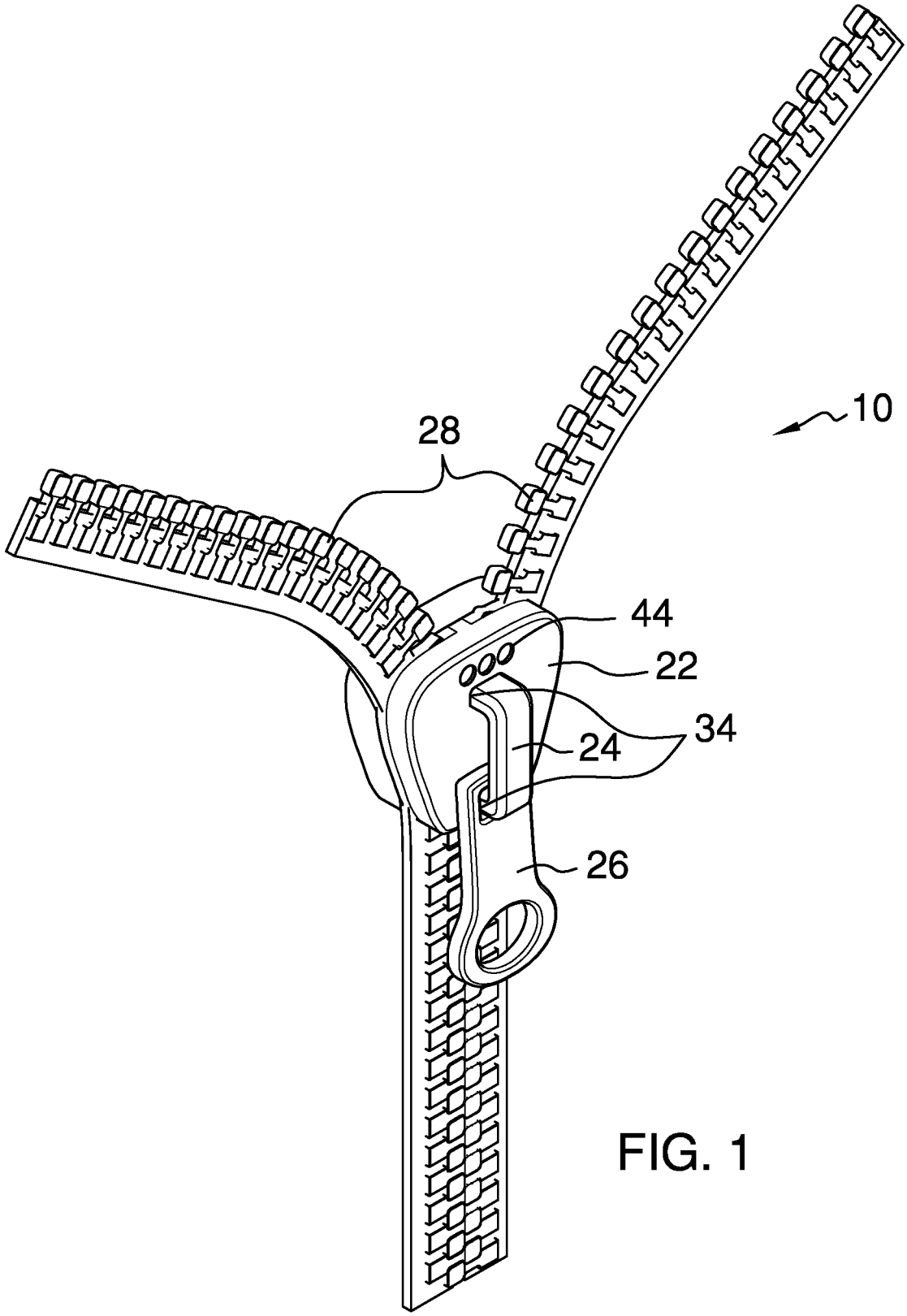
FIG. 1 is a front isometric view.
Figure 2:
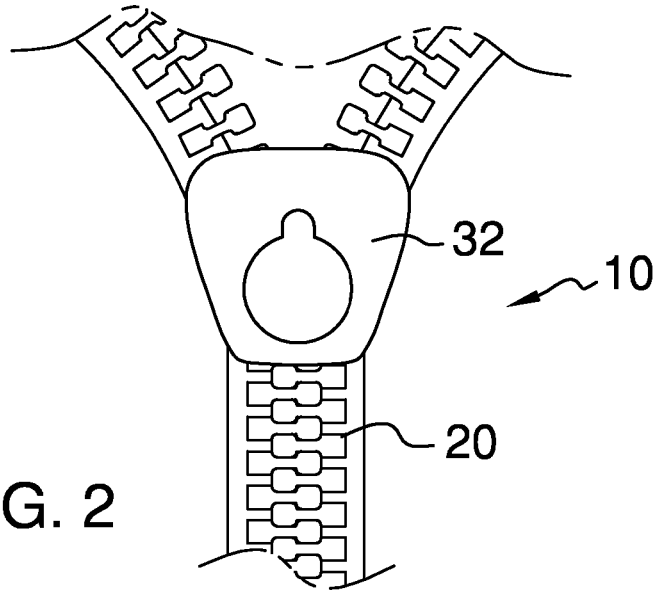
FIG. 2 is a rear elevation view.
Figure 3:
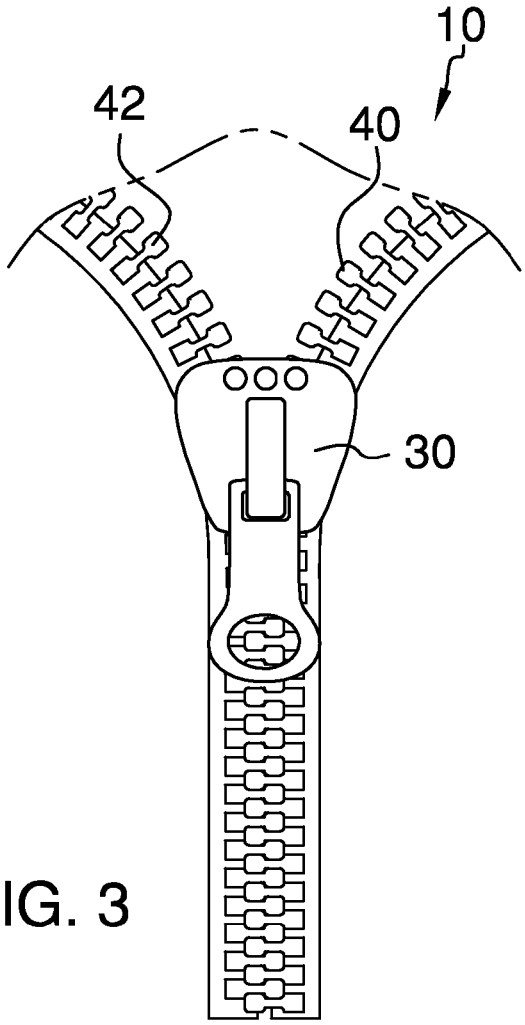
FIG. 3 is a front elevation view.

With reference now to the drawings, and in particular FIGS. 1 through 5 thereof, an example of the instant musical zipper employing the principles and concepts of the present musical zipper and generally designated by the reference number 10 will be described.

Referring to FIGS. 1 through 5 the present musical zipper 10 is illustrated. The musical zipper 10 includes a zipper 20 having a slider 22, a continuous C-shaped flap 24, a pull tab 26, and a pair of interlocking teeth 28. The slider 22 has a front surface 30 and a rear surface 32. The flap 24 has a pair of outer ends 34 attached to the front surface 30 of the slider 22. The pull tab 26, having a top end 36 and a bottom end 38, engages the flap 24. The pair of interlocking teeth 28 includes a first interlocking member 40 and a second interlocking member 42. A speaker 44 is disposed on the front surface 30 of the slider 22. A sound chip 46 is disposed within the slider 22. The speaker 44 and the sound chip 46 are in operational communication with each other.

The slider 22 is configured to travel from a first end 48 of the zipper 20 to a second end 50 of the zipper 20 to connect the first interlocking member 40 with the second interlocking member 42. The slider 22 is configured to travel from the second end 50 of the zipper 20 to the first end 48 of the zipper 20 to disconnect the first interlocking member 40 from the second interlocking member 42.

Figure 4:
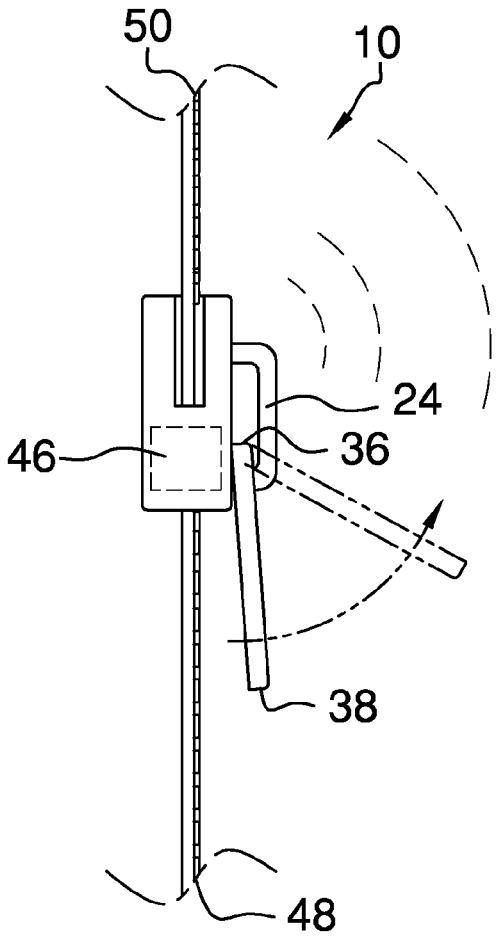
FIG. 4 is a side elevation view.
Figure 5:
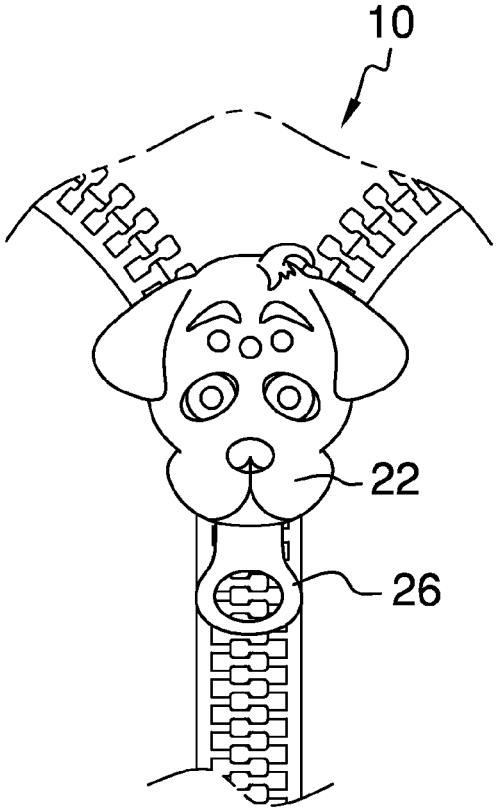
FIG. 5 is a front elevation view showing a design on a slider.

As best shown in FIG. 4, the pull tab 26 optionally has an on position and an alternate off position. The pull tab 26 is in the on position when the bottom end 38 is disposed above the slider 22. The pull tab 26 is in the off position when the bottom end 38 is disposed below the slider 22.

What is claimed is:

1. A musical zipper comprising:

a zipper comprising a slider having a front surface and a rear surface, a continuous C-shaped flap having a pair of outer ends attached to the slider front surface, a pull tab engaging the flap, the pull tab having a top end and a bottom end, and a pair of interlocking teeth, the pair of interlocking teeth comprising a first interlocking member and a second interlocking member;

wherein the slider is configured to travel from a first end of the zipper to a second end of the zipper to connect the first interlocking member with the second interlocking member;

wherein the slider is configured to travel from the second end of the zipper to the first end of the zipper to disconnect the first interlocking member from the second interlocking member;

a speaker disposed on the slider front surface;

a sound chip disposed within the slider;

wherein the speaker and the sound chip are in operational communication with each other;

wherein the sound chip is configured to play a musical tune when the sound chip is activated.

2. The musical zipper of claim 1 wherein the pull tab has an on position and an alternate off position, wherein the pull tab is in the on position when the bottom end is disposed above the slider, wherein the pull tab is in the off position when the bottom end is disposed below the slider, wherein the pull tab is in operational communication with the sound chip, wherein the sound chip is configured to be activated when the pull tab is in the on position.

3. The musical zipper of claim 1 wherein the sound chip is configured to be activated when the slider travels from the first end of the zipper to the second end of the zipper.

* * * * *